US006959903B1

(12) United States Patent
West et al.

(10) Patent No.: US 6,959,903 B1
(45) Date of Patent: Nov. 1, 2005

(54) CAST IN PLACE CHIMNEY FORM

(76) Inventors: Albert C. West, 179 West St., Southbridge, MA (US) 01550; Donald B. Samia, 15 Lenox St., Worcester, MA (US) 01602

( * ) Notice: Subject to any disclaimer, the term of this patent is extended or adjusted under 35 U.S.C. 154(b) by 21 days.

(21) Appl. No.: 10/453,139

(22) Filed: Jun. 3, 2003

Related U.S. Application Data

(60) Provisional application No. 60/385,647, filed on Jun. 4, 2002.

(51) Int. Cl.[7] ..... E04H 12/28; F23L 17/02

(52) U.S. Cl. ..... 249/17; 52/244; 52/218; 454/3; 454/13

(58) Field of Search ..... 52/218, 219, 301, 52/314, 315, 244, 742.14, 220.8; 249/17; 454/3, 4, 12, 367, 368

(56) References Cited

U.S. PATENT DOCUMENTS

| | | | | |
|---|---|---|---|---|
| 234,647 | A * | 11/1880 | Bates | 52/244 |
| 490,536 | A * | 1/1893 | Boston | 52/244 |
| 820,014 | A * | 5/1906 | Ries | 249/17 |
| 1,088,060 | A * | 2/1914 | Carter | 52/244 |
| 1,504,264 | A * | 8/1924 | Nelson et al. | 249/17 |
| 2,800,850 | A * | 7/1957 | McKann | 454/3 |
| 4,711,060 | A * | 12/1987 | Scherrer | 52/222 |
| 4,920,867 | A * | 5/1990 | Joly | 454/3 |
| 5,099,047 | A * | 3/1992 | Sato et al. | 556/136 |
| 5,291,706 | A * | 3/1994 | Beardsley et al. | 52/218 |
| 6,508,907 | B1 * | 1/2003 | Lutz | 156/304.3 |
| 2003/0014926 | A1 * | 1/2003 | Champa et al. | 52/60 |
| 2004/0016191 | A1 * | 1/2004 | Whitty | 52/232 |

* cited by examiner

*Primary Examiner*—Robert Canfield
(74) *Attorney, Agent, or Firm*—Alix, Yale & Ristas, LLP

(57) ABSTRACT

A cast in place chimney form and installation method therefor. The cast in place form being of a relatively light weight construction and having physical and visual features that allow it to be used as a chimney cap form and to be left as an element of the finished chimney cap. The method of installation comprising the positioning of the form with relation to a step of chimney construction and the pouring of the chimney cap with the form being left in place.

10 Claims, 5 Drawing Sheets

CAST IN PLACE CHIMNEY FORM

This application Claims Benefit of U.S. Provisional 60/385,647, filed Jun. 4, 2002.

BACKGROUND OF THE INVENTION

This invention relates generally to devices and methods for constructing chimney caps.

The chimney cap is a well-known feature found in chimney construction. The chimney cap serves the purpose of preventing moisture from entering the chimney between the chimney liner and the masonry portion of the chimney. This function is important since any water that enters into this space may cause moisture to build up in the masonry work of the chimney and eventually cause spalling and cracking of the masonry if subjected to repeated freezing and thawing, or effloresence on the masonry surface. The cap also serves to keep moisture from pooling on the surface of the top of the chimney and is sloped to keep water out of the flue. The cap is conventionally designed to overhang the chimney body wall. The overhanging portion presents a surface from which water, melting snow or ice can fall free of the chimney body, thus keeping moisture away from the masonry joints in the body.

Chimney caps are typically constructed utilizing wooden forms that are built in place at the top of the chimney. The wooden forms are temporary and are attached to the chimney during final stages of completion. These wooden forms serve as a receptacle for receiving poured concrete or other approved material. In addition, rebar or reinforcing mesh is added to the form so that concrete will not suffer cracking or damage due to shrinkage or thermal expansion that takes place during drying of the concrete or during usage of the chimney.

Standard pour in place chimney cap construction requires that form materials be brought up on the roof and assembled in place at the site to which they are going to be used. Optionally, the form can be constructed on the ground, but this option is problematic because the pre-assembled wood form is heavy and difficult to manipulate and position into place. The involvement of heavy materials and the time inefficient construction of forms is generally inconvenient for the builder of the chimney. Additionally, the manipulation of the form, parts and tools, as well as the heavy material used to construct the form, decreases the margin of safety to the chimney builder. The present invention is directed toward addressing these concerns.

SUMMARY OF THE INVENTION

The present invention is directed towards a lightweight convenient form to create a pour in place chimney cap. The form is preferably made of a material generally known as fiberglass. Fiber or ceramic composites, molded or glued plastics, and corrosion resistant coated metal forms may also be utilized. The form is textured on the outside surfaces to resemble typical materials used for the construction of chimneys, such as stone, brick, or concrete. The form is of a molded one-piece construction, but can be of a multiple part construction depending on such variables as chimney size and installation location.

The form has walls and a base. The base has a central opening. The opening in the base of the form is initially covered by a material. The top portions of the walls may have a channel that runs substantially around the inside perimeter of the form. The channel serves to prevent the concrete from pulling away from the wall of the form as it dries and thereby allowing water to get between the form and the concrete.

The method of using the form comprises cutting a hole in the material that covers the opening in the base so that the chimney flue may extend through it. The form is placed over the chimney flue until it rests on the masonry surrounding the flue. Following generally accepted chimney construction practice, expansion joint material, caulk, metallic or polymer flashing, reinforcing material, and any other commonly used materials may be utilized. Concrete or other materials that conform with building codes or with other construction guidelines are poured into the form.

BRIEF DESCRIPTION OF THE DRAWINGS

The invention will be better understood by reference to the accompanying drawing in which.

DESCRIPTION OF THE PREFERRED EMBODIMENT

Figure 1:
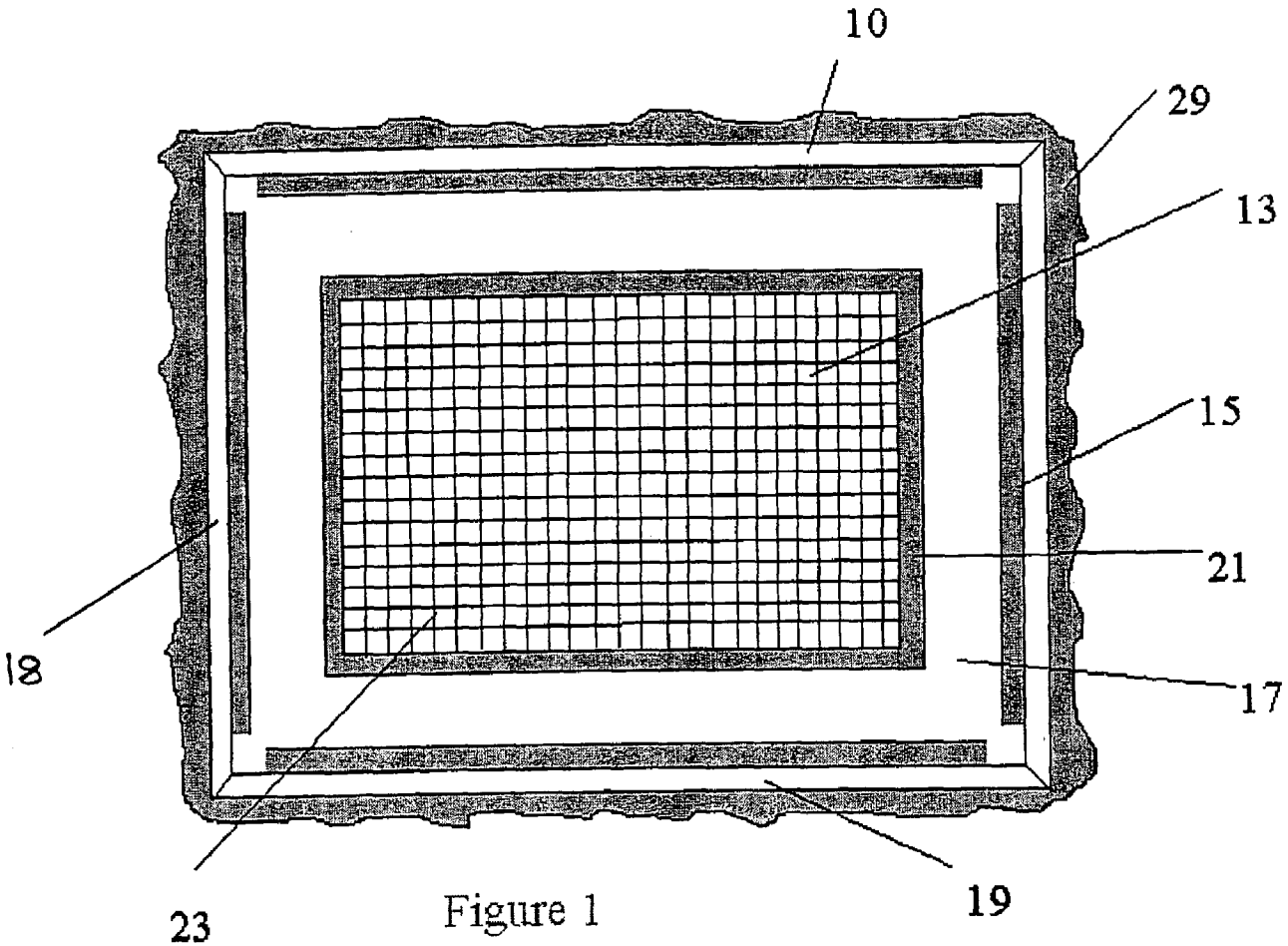
FIG. 1 is a top plan view of a cast in place chimney cap form.
Figure 2:
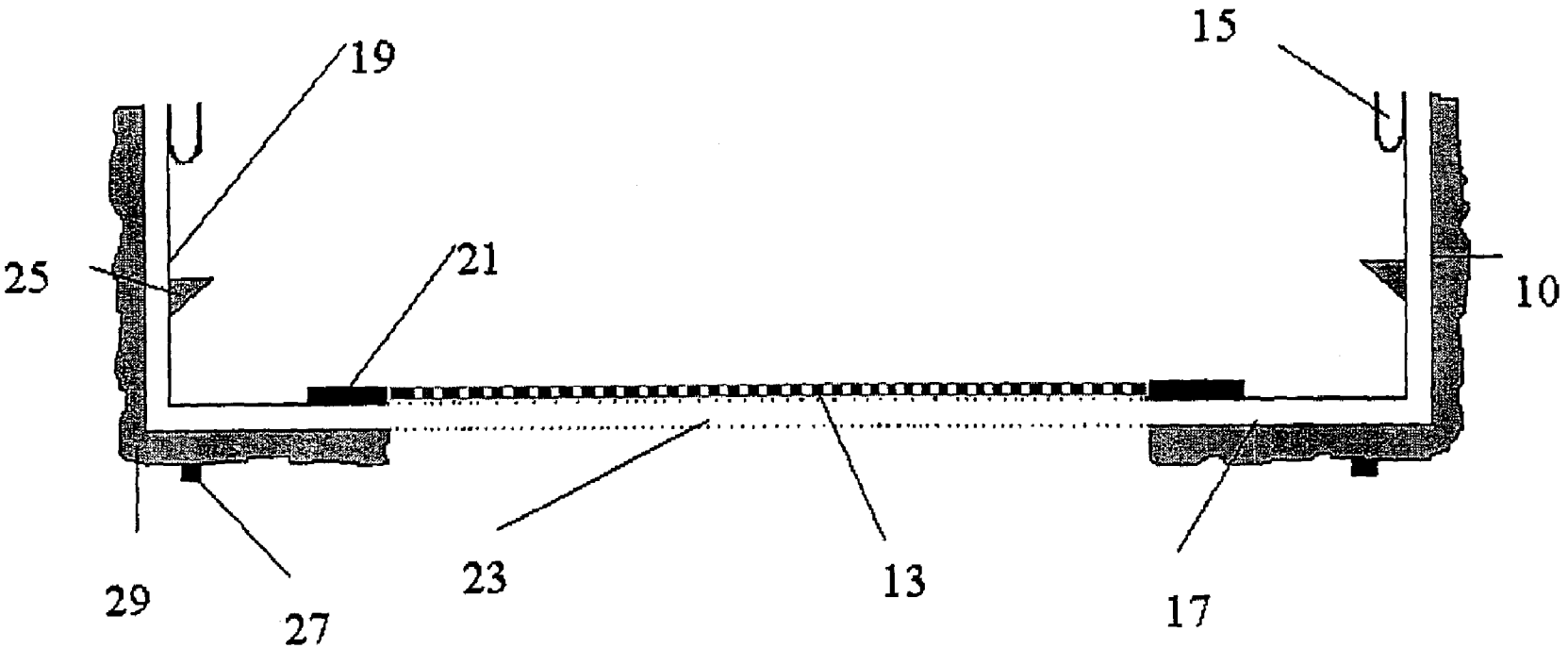
FIG. 2 is a side sectional view of the cast in place chimney cap form of FIG. 1.
Figure 3:
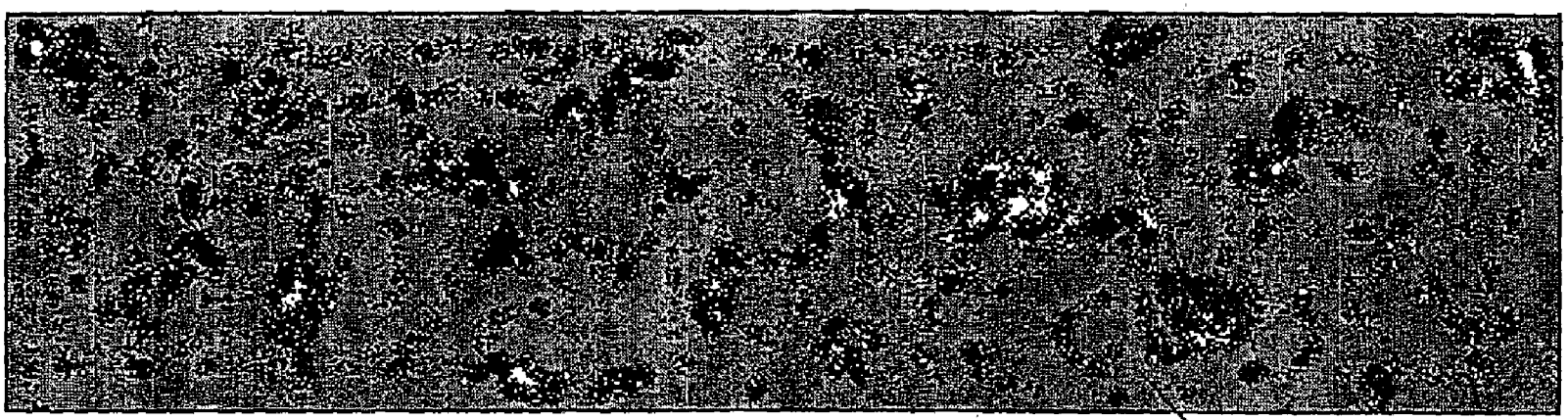
FIG. 3 is a representative side view of a cast in place chimney cap form.
Figure 4:
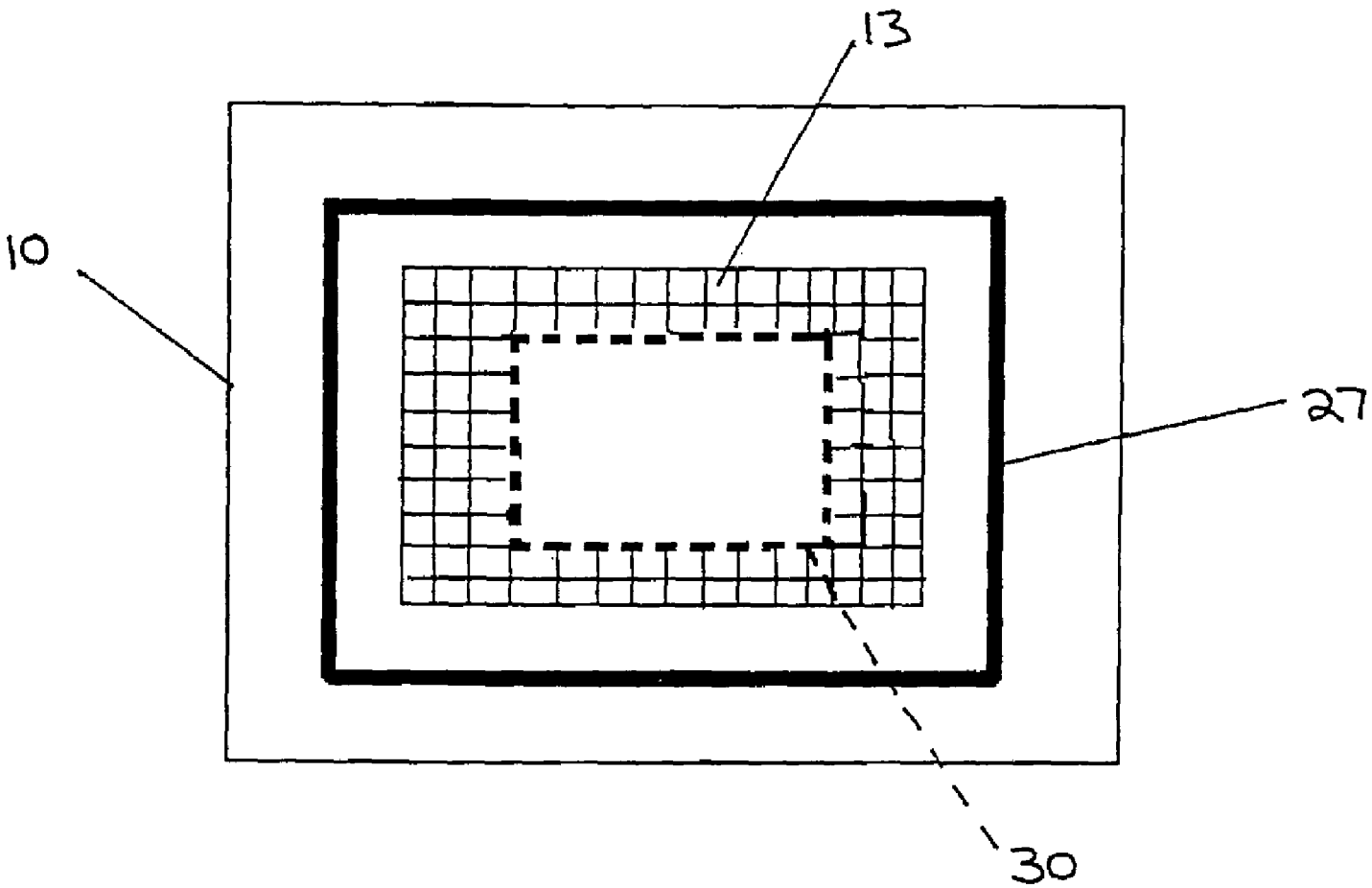
FIG. 4 is a bottom plan view of a cast in place chimney cap form.
Figure 5:
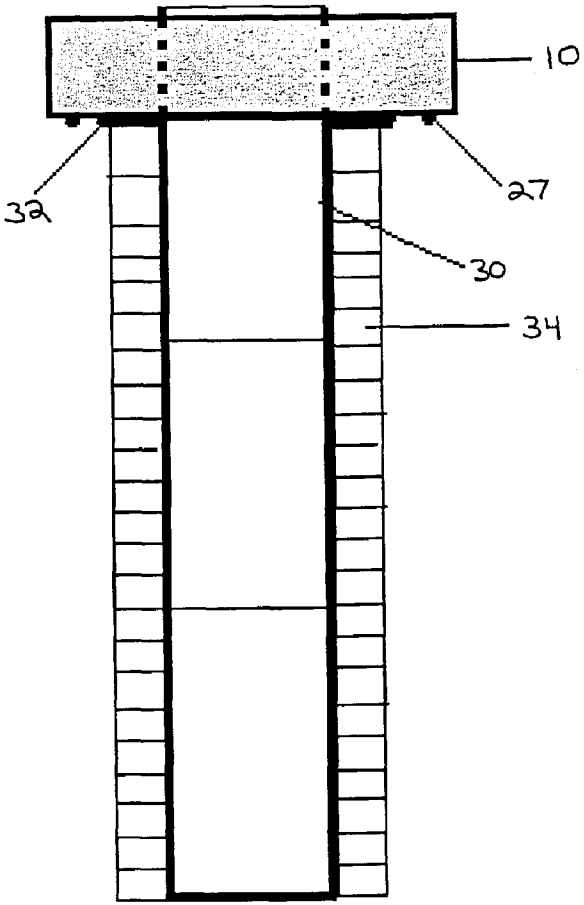
FIG. 5 depicts a cast in place chimney cap form in position on a chimney.

With reference to FIGS. 1–3 wherein like reference numbers refer to like parts throughout the Figures, a cast in place chimney cap form in accordance with the present invention is generally designated by the numeral 10.

The preferred cast in place chimney cap form 10 is made of molded fiberglass and has a generally rectilinear box-like shape. The form has a frame-like base 17, and two opposed sets of walls 18 and 19. The base of the form has a central opening 23. The opening of the base is covered with a galvanized mesh material 13. The cover material can, depending on the installation requirements, be materials other than galvanized wire, for instance other metals, polymers and/or natural or synthetic fabrics or strands. The mesh material overlaps the base 21 and may be attached to the base with fiberglass resin or other adhesive well known in the art. The outside surface of the walls and base can be finished to resemble such materials as stone 29. The inside top surfaces of the walls have a channel 15 that is molded into the walls. The channel serves to prevent the concrete from pulling away from the wall of the form as it dries and thereby allowing water to get between the form and the concrete. The channel may be segmented, or be a continuous structure which extends circumferentially around the inside of the form walls. In one embodiment of the invention the channel is disposed at the top of the walls. In one embodiment the invention forms an open receptacle to receive chimney cap materials. Chimney cap material may be include concrete. As well known by those of skill in the art, concrete is generally of a heavy moist nature that can place extreme stress on form structures. It is well known that structures may "blow out" if inadequately constructed or configured to support the stress exerted by the concrete, and are thus inadequate to serve as a form.

In another preferred embodiment, the form as described above has a shelf, ledge, or tab 25 that extends along the inside perimeter of the walls. The shelf 25 is preferably molded at the inside surface of the walls. The shelf 25 functions to receive reinforcing material to be attached or supported. In one embodiment of the invention the shelf is spaced from the base. Additionally, the outside/underside surface of the base may have a drip edge 27 attached to, or molded into it. The drip edge 27 extends around the bottom surface of the base and is positioned between the edge of the opening in the base, and the edge where the base and the walls intersect. In one embodiment of the invention, the drip edge may be a groove in the base.

The invention embodies a method for creating a cast in place chimney cap, using the cast in place chimney cap form. The method comprises cutting a hole in the galvanized mesh 13 that covers the opening in the base. The hole is configured to be complementary to flue shape so that the chimney flue 30 may extend through the hole. Flashing 32 may then be attached to the flue so that the flashing extends out over the masonry work 34 surrounding the flue. The cast in place chimney form 10 is then placed over the chimney flue until it rests on flashing. Expansion joint material may then be applied to the outside surface of the flue. The expansion joint will be then located between the outside flue surface and the poured chimney cap material. The use of expansion joint is well known in the art and provides for the expansion and contraction of construction materials in order to, for example, prevent cracking of material that otherwise would be in abutment. Reinforcing material may then be placed into the form. Reinforcing material may be rested, attached or otherwise fixed within the form. In one embodiment of the invention the reinforcing material may be rested on the ledge 25. Concrete, for example, is then poured into the form. Other material well known in the art may be used in place of, or in addition to concrete. For instance, resins such as epoxies and polyester may be combined with aggregate and/or other filler such as fumed silica. After the chimney cap material is cured, the form remains in place as an integral part of the chimney cap structure. The outer surface of the form gives the form a look and texture of classic materials used in chimney construction. For instance the outer surface may have a look and texture of stone 29, brick, and/or concrete.

It should be understood that while preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A cast in place chimney form comprising:

a frame-like base with an opening and an interior and an exterior surface:

a cover positioned to cover the opening;

walls having inside and outside surfaces, said walls extending from the base, to form an open receptacle for receiving chimney cap materials; and a channel that runs along the inside surface of the walls.

2. The cast in place chimney form of claim 1, wherein the cover has a cut out portion.

3. The cast in place chimney form of claim 1, wherein the base and walls are constructed from fiberglass.

4. The cast in place chimney form of claim 1, wherein the cover is mesh.

5. The cast in place chimney form of claim 1, further including a ledge extending from the inside surface of the walls and spaced from the base.

6. A cast in place chimney form comprising:

a frame-like base with an opening and an interior and an exterior surface;

a cover positioned to cover the opening;

walls having inside and outside surfaces, said walls extending from the base, to form an open receptacle for receiving chimney cap materials; and a drip edge along a portion of the exterior surface of the base.

7. The cast in place chimney form of claim 6, wherein the drip edge is a continuous raised ridge that encircles the opening.

8. A cast in place chimney form comprising:

a frame-like base with an opening and an interior and an exterior surface;

a cover positioned to cover the opening:

walls having inside and outside surfaces, said walls extending from the base, to form an open receptacle for receiving cap materials, wherein the receptacle has an open top and further comprises a channel disposed at the top and adjacent at least one said wall.

9. The cast in place chimney form of claim 8, wherein the channel is a continuous structure which extends circumferentially at the top of the receptacle.

10. A cast in place chimney form comprising:

a frame-like base with an opening and an interior and an exterior surface;

a cover positioned to cover the opening; and walls having inside and outside surfaces, said walls extending from the base, to form an open receptacle for receiving chimney cap materials, wherein the exterior surface of the base and the outside surface of the walls resemble stone.

* * * * *